United States Patent [19]

Fujimaki et al.

[11] Patent Number: 4,477,549

[45] Date of Patent: Oct. 16, 1984

[54] PHOTORECEPTOR FOR ELECTROPHOTOGRAPHY, METHOD OF FORMING AN ELECTROSTATIC LATENT IMAGE, AND ELECTROPHOTOGRAPHIC PROCESS

[75] Inventors: Yoshihide Fujimaki; Yoshiaki Takei; Hiroyuki Nomori, all of Hachioji, Japan

[73] Assignee: Konishiroku Photo Industry Co., Ltd., Japan

[21] Appl. No.: 422,728

[22] Filed: Sep. 24, 1982

[30] Foreign Application Priority Data

Sep. 28, 1981 [JP] Japan ..... 56-151976
Sep. 28, 1981 [JP] Japan ..... 56-151978

[51] Int. Cl.[3] ..... G03G 13/24

[52] U.S. Cl. ..... 430/54; 430/66; 430/57; 430/126

[58] Field of Search ..... 430/66, 57, 58, 31, 430/54

[56] References Cited

U.S. PATENT DOCUMENTS 3,904,406 9/1975 Takahashi ..... 430/67
4,308,330 12/1981 Kaukeinen et al. ..... 430/57

*Primary Examiner*—John D. Welsh
*Attorney, Agent, or Firm*—Jordan B. Bierman

[57] ABSTRACT

A highly sensitive photoreceptor for electrophotography that forms a sharp image during repeated use is disclosed. It comprises an electrically conductive support having successively formed thereon a photoconductive photosensitive layer and a protective layer for that photosensitive layer, said photosensitive layer comprising an organic photoconductive material and said protective layer comprising an amorphous silicon carbide or amorphous silicon nitride containing a hydrogen atom and/or a fluorine atom. A method of forming a latent electrostatic image and an electrophotographic process using such photoreceptor are also disclosed.

22 Claims, 13 Drawing Figures

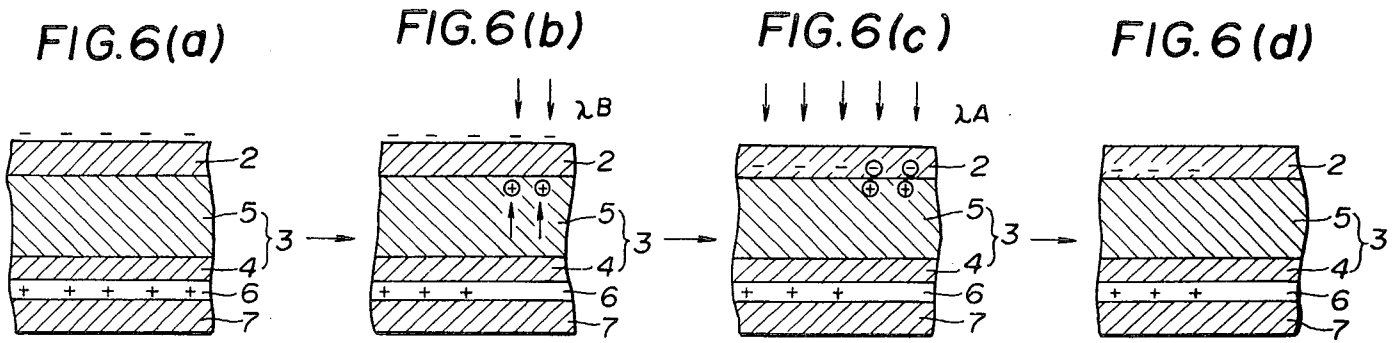
FIG.6(a)
FIG.6(b)
FIG.6(c)
FIG.6(d)
λB
λA
2
3
4
5
6
7
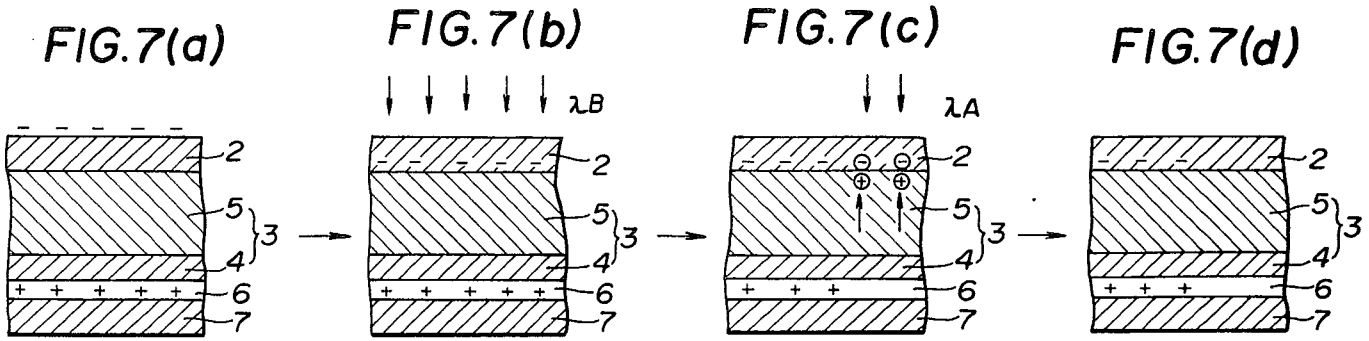
FIG.7(a)
FIG.7(b)
FIG.7(c)
FIG.7(d)
λB
λA
2
3
4
5
6
7

PHOTORECEPTOR FOR ELECTROPHOTOGRAPHY, METHOD OF FORMING AN ELECTROSTATIC LATENT IMAGE, AND ELECTROPHOTOGRAPHIC PROCESS

FIELD OF THE INVENTION

The present invention relates to a new photoreceptor for electrophotography that is very sensitive and provides a sharper image than the conventional product and which withstands cyclic use over an extended period. The invention also relates to a method of forming an electrostatic latent image and an electrophotographic process using such photoreceptor. More particularly, the present invention relates to a new photoreceptor that comprises an electrically conductive support which has successively formed thereon a photoconductive photosensitive layer and a layer to protect said photoconductive layer, as well as a method of forming an electrostatic latent image and an electrophotographic process using such photoreceptor.

BACKGROUND OF THE INVENTION

Typical conventional photoreceptors for electrophotography contain one of the following photosensitive layers on an electrically conductive support: a vapor-deposited layer of Se, Se-Te alloy or Se-As alloy, a layer having CdS or ZnO particles dispersed in a resin, a layer having the particles of phthalocyanine pigment derivative dispersed in a resin, and an organic photoconductive layer containing poly-N-vinylcarbazole (hereinafter referred to as PVK) and/or 2,4,7-trinitro-9-fluorenone (hereinafter TNF). When these photoreceptors are subjected to cyclic use, the photosensitive layer is fatigued or its surface is mechanically damaged or worn. The causes of the fatigue are bombardment due to corona discharge during the charging step, and the degradation due either to active gases produced during charging or to light illumination. The causes of mechanical damage or wear are the friction with a receiving sheet as it is peeled after the toner image has been transferred to it, and the contact with the material to clean the drum. For these reasons, it becomes necessary quite soon to mirror-polish the surface of the photosensitive layer, or replace the photoreceptors using other photosensitive layers.

It is known to form a protective layer on the photosensitive layer to prevent its fatigue or surface wear or damage. Japanese Patent Publication No. 24414/77 discloses a photoreceptor for electrophotography, including a photoconductive photosensitive layer of selenium, selenium-arsenic or selenium-tellurium that is coated with a protective layer of a thickness of 0.5 to 5μ, that comprises a combination of three resins selected from among polyester, polyurethane, polyvinylidene chloride, acetylcellulose, polyacrylonitrile and polyvinyl chloride. Japanese Patent Application (OPI) No. 3749/78 (the symbol OPI as used hereunder means an unexamined published Japanese patent application) discloses a photoreceptor for electrophotography including a photoconductive photosensitive layer of selenium, selenium-tellurium, selenium-arsenic or selenium-tellurium-arsenic that is coated with a protective layer of a thickness of 0.2 to 5μ that comprises a combination of glycol-modified silicone resin and one resin selected from among an acylic resin, acryl-urethane resin, urethane resin, polyester resin and epoxy resin.

These two photoreceptors are adapted for use in cyclic transfer electrophotography using the Carlson process, but the protective layer in the first type of photoreceptor is not capable of the desired protection against fatigue, particularly against mechanical wear if its thickness is only a few microns, and a significant improvement is achieved only if the thickness is increased to several tens of microns. But if such a thick protective layer is formed on the photosensitive layer, not all the electrical charges can be removed from the photosensitive layer by either optical or electrical erase means, and as the photoreceptor is subjected to cyclic transfer electrophotography, the buildup of residual charge causes considerable fog and makes the subsequent formation of an image impossible. In spite of this fact, Japanese Patent Publication No. 23910/67 proposes a photoreceptor that uses a very thick resin layer to protect a photosensitive layer. This photoreceptor has an insulating resin layer of a thickness of about 100μ formed on a photosensitive layer having photoconductive CdS particles dispersed in a resin binder, and it claims the prevention of not only fatigued photosensitive layer due to light, active gases or electron bombardment but also mechanically damaged photosensitive layer. But on the other hand, the use of this photoreceptor has led to the need of the complex image forming process described in that patent, namely, the "NP process" that consists of charging, imagewise exposure, reverse charging (or a.c. charging) and full-frame exposure and which requires two different charging devices. This inevitably results in a complex image forming apparatus and process.

Another method to protect the photosensitive layer is to use a double-layer photoreceptor comprising a charge transport layer and a charge generating layer, and specific examples of this method are described in Japanese Patent Applications (OPI) Nos. 116930/79, 1943/81 and 60446/81. In each patent, the photoreceptor comprises a fairly thin photoconductive layer of high sensitivity and low resistance that includes a photosensitive layer which generates carriers upon illumination with visible light. Generally, such charge generating layer is used as the underlying layer and is formed on a substrate, and on that layer is formed a charge transport layer that is capable of transporting the charges generated in said charge generating layer. This transport layer is made of a relatively thick, transparent photoconductive layer that has high resistance and good physical properties, and is generally made of a photoconductive resin layer or a resin layer containing a photoconductive material. When the above named patents were filed, the inventors expected that the photosensitive layer (charge generating layer) would be protected from light, electron bombardment and active gases, as well as from mechanical wear, damege and moisture and that it would provide a photoreceptor adapated for use in the Carlson process with minimum fatigue. But as it turned out, the charge transport layer that comprised resins which were inherently low in mechanical properties could not be subjected to long-term cyclic operation without mechanical damage or loss in the ability of transporting charges. Japanese Patent Publication No. 25218/74 proposed a three-layer photoreceptor that comprised an underlying highly photosensitive photoconductive layer, a thin intermediate layer of insulating organic compound and an overlaying photoconductive layer that absorbs light in a different wavelength region than that of the photosensitive layer. The underlying layer is typically made of arsenic triselenide and has high sensitivity and low resistance, and this is overlaid with a thin insulating layer made of an inorganic compound such as $SiO_2$, ZnS or $MgF_2$, and this intermediate layer is further coated with a photoconductive resin layer typycally comprising polyvinyl carbazole that absorbs light only in the ultraviolet or short wavelength range. In this three-layer arrangement, the intermediate layer and overlaying layer protect the underlying photosensitive layer from fatigue and wear, but because of its three-layer structure, two different charging devices, i.e. a d.c. corona discharger and an a.c. corona discharger, are necessary as demonstrated below, and this again results in a complex image forming apparatus and process. When the surface of this photoreceptor is subjected to a uniform negative charging, positive charges are induced in the vicinity of the intermediate layer since the photosensitive layer of arsenic triselenide has low resistance (this completes the first step). Then, the surface of the photoreceptor is subjected to a.c. corona discharge, and at the same time, it is subjected to imagewise exposure using light to which only the underlying layer is sensitive, and an electrostatic latent image is formed (this completes the second step). Subsequently, to increase the contrast of the latent image, the photoreceptor is subjected to full-frame exposure with light that is absorbed by the overlaying layer (this completes the third step). The so treated photoreceptor is subjected to the conventional transfer method comprising development of the toner image, transfer of the developed image to a receiving sheet, typically paper, and fixing the transfer image.

As described above, no photoreceptor for cyclic transfer electrophotography has been found that can be subjected to long-term cyclic operation without buildup of residual charges that cause fog and fatigue, and no image forming method that uses such photoreceptor has been found either.

SUMMARY OF THE INVENTION

Therefore, one object of the present invention is to provide a photoreceptor comprising an organic semiconductor having a protective layer that has good optical characteristics and is adapted for use in electrophotography by the Carlson process without residual potential buildup during cyclic operation, and which is stable against varying temperature and humidity conditions, and which requires a thickness of only a few microns to achieve satisfactory mechanical strength.

Another object of the invention is to provide a method of forming a latent electrostatic image and an electrophotographic process that are capable of producing a sharp image by a simple image forming procedure using such photoreceptor.

The first object of the present invention can be achieved by a photoreceptor that comprises an electrically conductive support having successively formed thereon a photoconductive photosensitive layer and a protective layer for that photosensitive layer, said photosensitive layer comprising an organic photoconductive material and said protective layer comprising an amorphous silicon carbide or an amorphous silicon nitride containing a hydrogen atom and/or a fluorine atom.

The second object of the present invention can be achieved by a method of forming a latent electrostatic image including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of imagewise exposure to light that is absorbed by said photosensitive layer but not substantially absorbed by said protective layer, and an optional step of full-frame exposure to light that is absorbed by said protective layer but not substantially absorbed by said photosensitive layer.

In a preferred embodiment, the imagewise exposure (which may or may not be followed by a full-frame exposure) or the full-frame exposure (which is followed by an image-wise exposure) is effected simultaneously with or immediately before the formation of a uniform charge layer or it is effected thereafter, and said protective layer comprises a photoconductive inorganic compound.

The second object of the present invention can also be accomplished by any one of the following three electrophotographic processes: (1) a process including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of ull-frame exposure to light that is absorbed by said protective layer but not substantially absorbed by said photosensitive layer, said full-frame exposure being effected simultaneously with or immediately before the formation of a uniform charge layer or thereafter, a step of imagewise exposure to form a latent electrostatic image with light that is absorbed by said photosensitive layer but not substantially absorbed by said protective layer, a step of forming a visible image by developing the latent image with a developer containing charged particles, a step of transferring the visible image onto a receiving sheet to form a transfer image and fixing it, and a step of erasing any residual charges by illuminating the entire surface of the photosensitive layer with cleaning light and/or by applying an a.c. voltage thereto; (2) a process including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of imagewise exposure to light that is absorbed by said photosensitive layer but not substantially absorbed by said protective layer, said imagewise exposure being effected simultaneously with or immediately before the formation of a uniform charge layer or thereafter, a step of full-frame exposure to form a latent electrostatic image with light that is absorbed by said protective layer but not substantially absorbed by said photosensitive layer, a step of forming a visible image by developing the latent image with a developer containing charged particles, a step of transferring the visible image onto a receiving sheet to form a transfer image and fixing it, and a step of erasing any residual charges by illuminating the entire surface of the photosensitive layer with cleaning light and/or by applying an a.c. voltage thereto; and (3) a process including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than for said protective layer, a step of imagewise exposure to form a latent electrostatic image with light that is absorbed by said photosensitive layer but not substantially absorbed by said protective layer, said imagewise exposure being effected simultaneously or immediately before the formation of a uniform charge layer or thereafter, a step of forming a visible image by developing the latent image with a developer containing charged particles, a step of transferring the visible image onto a receiving sheet to form a transfer image and fixing it, and a step of erasing any residual charges by illuminating the entire surface of the photosensitive layer with cleaning light and/or by applying an a.c. voltage thereto.

In a preferred embodiment, the cleaning light used to erase any residual charges is absorbable by said photosensitive layer or by both said photosensitive layer and protective layer, and said protective layer comprises a photoconductive inorganic compound.

BRIEF DESCRIPTION OF THE DRAWINGS

FIGS. 6 and 7 are schematic representations of the sequence of forming a latent electrostatic image according to the present invention.

DETAILED DESCRIPTION OF THE INVENTION

One feature of the method of forming a latent electrostatic image and the electrophotographic process of the present invention (both are hereunder collectively referred to as an image forming method) lies in using a photoreceptor that comprises an electrically conductive support having successively formed thereon a photoconductive photosensitive layer and a photoconductive protective layer preferably comprising a hard inorganic compound, said photosensitive layer absorbing at least light in a wavelength range other than that for said protective layer. Another feature lies in the use of such photoreceptor in a modification of the Carlson process (cyclic transfer electrophotography) including a step of forming a uniform charge layer across the photoreceptor, a step of imagewise exposure to light that is substantially absorbed by the photosensitive layer only, and an optional step of full-frame exposure to light that is substantially absorbed by the protective layer only, followed by development, transfer and fixing steps. Since the protective layer is made of a thin layer comprising a hard photoconductive inorganic compound, the photoreceptor can be subjected to cyclic operation without fatigue or mechanical wear or damage, and what is more, the minimum buildup of residual charges helps the image forming method of the present invention provide a sharp image having no fog in the background.

Figure 1:
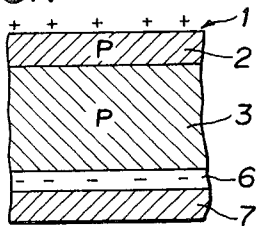
FIGS. 1 to 3 are enlarged cross-sectional views showing typical embodiments of the photoreceptor of the present invention wherein a uniform positive charge layer is formed on its surface.
Figure 2:
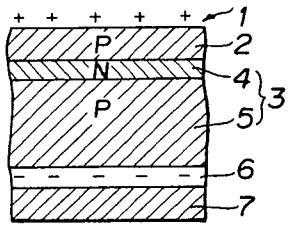
Figure 3:
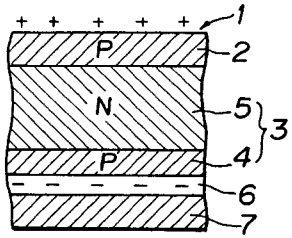

One preferred embodiment of the photoreceptor of the type wherein a uniform positive charge layer is formed on its surface is illustrated in FIG. 1 and it includes a single photosensitive layer 3 and a protective layer 2 both of which are made of a p-type photoconductive layer. In the embodiments shown in FIGS. 2 and 3, the photoreceptor includes a photosensitive layer that consists of a charge transport layer 5 and a charge generating layer 4. In FIG. 2, the photoreceptor consists of a substrate 7 that has successively formed thereon a charge transport layer 5, a charge generating layer 4 and a protective layer 2, and in FIG. 3, the order of the two photosensitive layers is reversed and the charge generating layer 4 is placed under the charge transport layer 5. In the embodiments of FIGS. 2 and 3, the arrangement of the photoconductive layers is preferably p-n-p type. A photoreceptor of the type wherein a uniform negative charge layer is formed on its surface is the same as the first type except that the p-n-p arrangement is replaced by an n-p-n arrangement.

In the first step of forming an image with the above described photoreceptor, a uniform positive or negative charge layer is formed on the protective layer 2. Upon full-frame exposure to light that is substantially absorbed by the protective layer 2, the charges migrate to the interface between the photosensitive layer (if it is a double-layer structure, either charge generating layer 4 or charge transport layer 5) and the protective layer 2. This interface must have a barrier that holds the charges in position and prevents them from flowing into the photosensitive layer unless an imagewise exposure is subsequently effected. Such barrier can be formed by vapor-depositing the protective layer 2 on the photosensitive layer by glow discharge or sputtering in vacuum as will be described hereunder.

Figure 4:
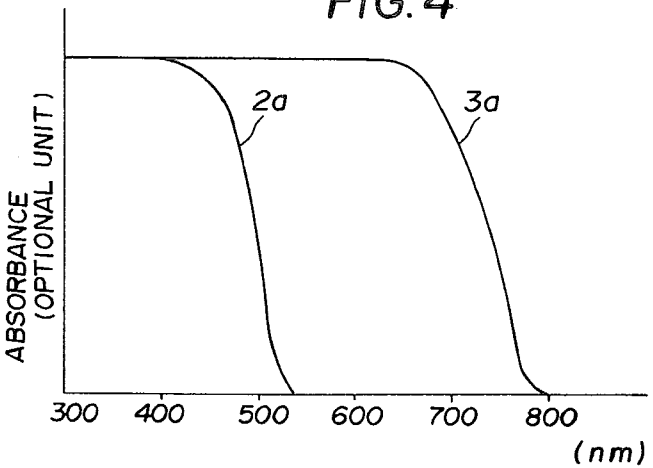
FIGS. 4 and 5 are graphs showing examples of the absorption characteristics of the photoconductive photosensitive layer and photoconductive protective layer included in the photoreceptor of the present invention.
Figure 5:
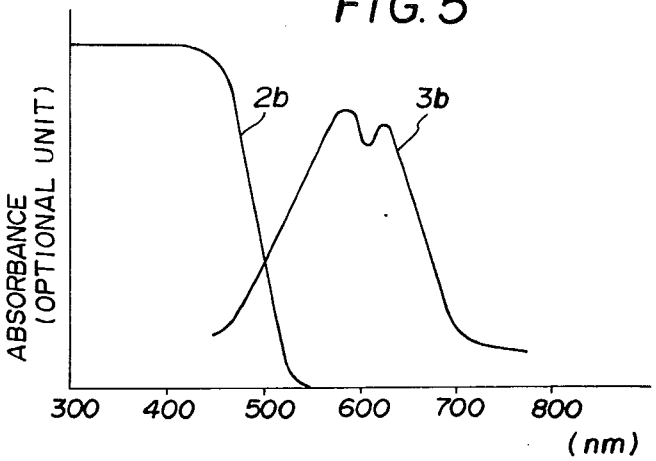

Typical examples of the absorption characteristics of the protective layer 2 and photosensitive layer 3 are shown in FIGS. 4 and 5. Generally, the protective layer 2 is illuminated with light of short visible wavelength to ultraviolet range (indicated by curve 2*a* in FIG. 4), so the protective layer is advantageously made of a material that has such absorption range. The photosensitive layer 3 is on the other hand illuminated with the light indicated by curve 3*a* in FIG. 4 that has the wavelength range of absorption for both the protective layer and photosensitive layer or the light indicated by curve 3*b* in FIG. 5 that is substantially absorbed by the photosensitive layer only, and therefore, the photosensitive layer is advantageously made of a material that has such absorption range. In a preferred embodiment, the photosensitive layer is subjected to imagewise exposure with a light source of high energy such as helium-neon laser having a radiation wavelength of about 6328 Å, and by so doing, an image of high resolution can be formed. But in this case, the photoconductive protective layer must be made of a highly durable material that withstands high-energy light. Another advantage of using such laser is that it also serves as a laser printer that forms an image cy controlling laser light with an external electrical signal.

The photoreceptor shown in FIG. 6(*a*) and FIG. 7(*a*) is of negatively chargeable type and comprises a substrate 7 with an electrically conductive layer 6 that has successively formed thereon a photosensitive layer 3 that is made of an underlying n-type photoconductive charge negerating layer 4 and an overlaying p-type photoconductive charge transport layer 5, and an n-type photoconductive protective layer 2. The protective layer and photosensitive layer have the wavelength ranges of absorption indicated by curves 2*a* and 3*a*, respectively, in FIG. 4 or by 2*b* and 3*b*, respectively, in FIG. 5.

Three typical image forming methods that are included in the present invention are described below. The sequence of the first method is illustrated in FIG. 6. A latent electrostatic image is formed by a process consisting of formation of a uniform negative charge layer on the entire surface of the protective layer 2, imagewise exposire with light $\lambda_B$ that is substantially absorbed by the photosensitive layer 3, and full-frame exposure with light $\lambda_A$ that is substantially absorbed by the protective layer. The latent image is then developed with a positively charged toner to form a toner image, which is transferred onto a receiving sheet and fixed. For another cycle of image forming, the residual charges are erased by light $\lambda_B$ or a combination of $\lambda_A+\lambda_B$ or by an a.c. corona discharge device, and the remaining toner image is cleaned with a blade. Referring to FIG. 6(*a*), the uniform negative charge layer formed on the protective layer induces positive charges at the interface between the electrically conductive layer 6 and charge generating layer 4. In FIG. 6(*b*), the protective layer is illuminated with light $\lambda_B$ for imagewise exposure, whereupon the positive charges move to the interface between the protective layer 2 and charge transport layer 5. As a result, only the illuminated part of the protective layer comes to have a low surface potential and a latent electrostatic image is formed in that area (in the third method to be described later, this latent image is immediately developed with a positively charged toner to form a toner image which is transferred to a receiving sheet and fixed thereon). In FIG. 6(*c*), the protective layer is illuminated with light $\lambda_A$ for full-frame exposure, whereupon the negative charges move from the surface of the protective layer to the interface between the protective layer and charge transport layer to neutralize the preoccupant positive charges. As a result, a latent electrostatic image of high contrast is formed as shown in FIG. 6(*d*), and this is developed with a toner to provide a sharper toner image which is transferred to a receiving sheet and fixed.

The sequence of the second image forming method is illustrated in FIG. 7. A latent electrostatic image is formed by a process consisting of formation of a uniform negative charge layer on the entire surface of the protective layer 2, full-frame exposure with light $\lambda_A$ and imagewise exposure with light $\lambda_B$. The latent image is subsequently processed as in the first method to provide a fixed image. Referring to FIG. 7(*a*), the uniform negative charge layer formed on the protective layer induces positive charges at the interface between the substrate 7 and charge generating layer 4. In FIG. 7(*b*), the protective layer is illuminated with light $\lambda_A$ for full-frame exposure, whereupon the negative charges move from the protective layer to the interface between the protective layer and charge transport layer 5. In FIG. 7(*c*), the protective layer is illuminated with light $\lambda_B$ for imagewise exposure, whereupon the positive charges move from the interface between the substrate and charge generating layer 4 to the interface between the protective layer and charge transport layer to neutralize the preoccupant negative charges. As a result, a latent electrostatic image is formed as shown in FIG. 7(*d*). This latent image is subsequently processed as in the first method to provide a fixed image.

The third image forming method is the same as the first method except that it does not include the step of full-frame exposure shown in FIG. 6(*c*).

In the first and second methods, the protective layer 2 included in the photoreceptor has photoconductivity, so any residual charge can be removed by full-frame exposure or subsequent erase or cleaning step, and a fog-free image can be produced. Even after repeated use, the photoreceptor can provide a sharp image without fatigue or wear. But in the third method that does not have the step of full-frame exposure, some surface charges remain in the exposed area and may cause fog, and this can be eliminated by using the bias development method with a two-component developer containing an insulating toner. In the first and second methods, any developer can provide the desired image and no bias application is necessary to eliminate fog. Therefore, good results are obtained by using a one-component developer made of an electrically conductive magnetic toner that does not permit bias application.

The imagewise exposure (in either method) or full-frame exposure (only in the first and second methods) is usually effected either simultaneously with or after the formation of a uniform charge layer, but equally good results are obtained by effecting them before the charging step if the interval is not longer than 10 milliseconds. Light $\lambda_B$ is usually employed as cleaning light to erase the residual charges, but for complete erasure, the combination of $\lambda_A+\lambda_B$ is preferred.

The photosensitive layer 3 is used in the photoreceptor of the present invention may be a single inorganic photoconductive layer formed of a vapor-deposited film of Se, Se-Te alloy, Se-As alloy or Se-Sb alloy or a single organic photoconductive layer formed of PVK or TNF, or may consist of a charge transport layer and a charge generating layer, such as the combination of PVK layer and Se layer, TNF layer and Se layer, oxadiazole derivative layer and perylene derivative layer (see U.S. Pat. No. 3,871,882), pyrazoline derivative layer and Chloro Diane Blue layer, and pyrazoline derivative layer and methyl squarylium layer. Suitable arrangements can be selected from among known organic and inorganic photoconductive layers.

The photoreceptor of double-layer structure that is preferably used in the image forming method of the present invention is now described in greater detail. The charge generator that is included in the charge generating layer may be selected from among any of the inorganic pigments and organic dyes that absorb visible light to generate free charges. Illustrative inorganic pigments include amorphous selenium, trigonal selenium, seleniumarsenic alloys, selenium-tellurium alloys, cadmium sulfide, cadmium selenide, cadmium sulfoselenide, mercury sulfide, lead oxide and lead sulfide. Typical organic dyes include:

(1) azo dyes such as monoazo dyes, polyazo dyes, metal complex salt azo dyes, pyrazolone azo dyes, stilbene azo dyes and thiazole azo dyes;

(2) perylene dyes such as perylenic anhydride and perylenic acid amide;

(3) anthraquinone or polycyclic quinone dyes such as anthraquinone derivatives, anthanthrone derivatives, dibenzopyrenequinone derivatives, pyranthrone derivatives, violanthrone derivatives and isoviolanthrone derivatives;

(4) indigoid dyes such as indigo derivatives and thioindigo derivatives;

(5) phthalocyanine dyes such as metal phthalocyanine and nonmetallic phthalocyanine;

(6) carbonium dyes such as diphenylmethane dyes, triphenylmethane dyes, xanthene dyes and acridine dyes;

(7) quinoneimine dyes such as azine dyes, oxazine dyes and thiazine dyes;

(8) methine dyes such as cyanine dyes and azomethine dyes;

(9) quinoline dyes;

(10) nitro dyes;

(11) nitroso dyes;

(12) benzoquinone and naphthoquinone dyes;

(13) naphthalimide dyes;

(14) perinone dyes such as bisbenzimidazole derivatives; and

(15) quinacridone dyes.

Examples of the binder resin that is included in the charge generating layer include addition polymerization resins, polyaddition resins and polycondensation resins such as polyethylene, polypropylene, acrylic resins, methacrylic resins, vinyl chloride resins, vinyl acetate resins, epoxy resins, polyurethane resins, phenolic resins, polyester resins, alkyd resins, polycarbonate resins, silicone resins and melamine resins, as well as copolymer resins including at least two of the recurring units of these resins, such as vinyl chloride-vinyl acetate copolymer resins, and vinyl chloride-vinyl acetate-maleic anhydride copolymer resins. Any other resins that are commonly used as binders can also be employed in the present invention.

A charge transport material having high mobility for charges of specific or non-specific polarity can be incorporated in the charge generating layer. Part or all of the charge transport materials that will be specified hereunder for inclusion in the charge transport layer 5 may also be incorporated in the charge generating layer, but other charge transport materials may of course be used depending on the specific performance of the photoreceptor. The charge generating layer may also contain one or more electron acceptors for the purposes of increased sensitivity, reduced residual potential and decreased fatigue during cyclic operation. Suitable examples of the electron acceptor are succinic anhydride, maleic anhydride, dibromomaleic anhydride, phthalic anhydride, tetrachlorophthalic anhydride, tetrabromophthalic anhydride, 3-nitrophthalic anhydride, 4-nitrophthalic anhydride, pyromellitic anhydride, mellitic anhydride, tetracyanoethylene, tetracyanoquinodimethane, o-dinitrobenzene, m-di-nitrobenzene, 1,3,5-trinitrobenzene, paranitrobenzonitrile, picryl chloride, quinone chloroimide, chloranil and bromanil.

Examples of the charge transport material included in the charge transport material 5 are oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, pyrazoline derivatives, oxazolone derivatives, benzothiazole derivatives, benzimidazole derivatives, quinazoline derivatives, benzofuran derivatives, acridine derivatives, phenazine derivatives, aminostilbene derivatives, poly-N-vinyl carbazole, poly-1-vinyl pyrene, poly-9-vinyl anthracene, 2,4,7-trinitrofluorenone, 2,4,5,7-tetranitrofluorenone and 2,7-dinitrofluorenone.

Various electrically conductive supports can be used in the photoreceptor of the present invention, such as those prepared by vapor-depositing or laminating metals (e.g. aluminum, palladium, copper, iron, nickel, stainless steel, gold, silver, tin, zinc, etc.) or metal oxides (e.g. tin oxide) on paper or plastic sheets, or those prepared by coating paper or plastic sheets with a layer having particles of the above listed metals or metal oxides or carbon black dispersed in a resin binder.

An intermediate layer made of vinyl chloride-vinyl acetate-maleic anhydride copolymer, casein, polyvinyl alcohol, ethyl cellulose or vinyl acetate may be provided between the conductive support and the photosensitive layer for the purpose of increasing the adhesion between these two layers or improving the electrostatic characteristics of the photosensitive layer.

A photosensitive layer may also be prepared by dispersing the particles of an inorganic photoconductive material such as ZnO or CdS in a binder resin.

The protective layer 2 used in the photoreceptor of the present invention is preferably made of a thin layer comprising a photoconductive inorganic compound. For various reasons such as high Vickers hardness, high mechanical strength, fairly great freedom in selecting the absorption characteristics and no pollution hazard, the protective layer is made of an amorphous silicon carbide or silicon nitride film having a hydrogen atom and/or a fluorine atom, namely, $Si_xC_{1-x}$:H, $Si_xC_{1-x}$:F, $Si_xC_{1-x}$:H:F, $Si_xN_{1-x}$:H, $Si_xN_{1-x}$:F and $Si_xN_{1-x}$:H:F (wherein $0<x<1$). The protective layer may be formed on the photosensitive layer by vapor-depositing a film of these materials in vacuum or by applying thereto a thin layer of a dispersion of these materials in a resin binder, and a vapor-deposited film of these materials is preferred.

The amorphous silicon carbide film having a hydrogen atom and/or a fluorine atom can be formed by sputtering or glow discharge. In the sputtering method, a Si or C target is sputtered at 0.01 to 1 Torr with argon gas containing hydrogen, fluorine or both hydrogen and fluorine that is introduced in a deposition chamber. In the glow discharge method, argon gas contining $SiH_4$ or $SiF_4$ mixed with a hydrocarbon gas such as $C_2H_4$ or a hydrogen fluoride gas such as $C_2F_4$ is introduced in a glow discharge device where it is decomposed by glow discharge at 0.1 to 1 Torr.

The amorphous silicon nitride film having a hydrogen atom and/or a fluorine atom can also be formed by sputtering or glow discharge. The glow discharge method is preferred for achieving precise control of the proportion of Si to N. In the glow discharge method, argon gas containing $SiH_4$ or $SiF_4$ and $NH_3$ or $NF_4$ is introduced in a glow discharge device where it is decomposed by glow discharge at 0.1 to 1 Torr.

The so prepared protective layer 2 has high mechanical strength and it preferably has a Vickers hardness of at least 500. The thickness of the protective layer is 0.01 to 5$\mu$, preferably from 0.05 to 1$\mu$.

In making the protective layer, care must taken to form a barrier between the protective layer and the underlying photosensitive layer that prevents the injection of carriers. Details of a technique for achieving this object are described in D. A. Anderson and M. E. Spear: Electrical and Optical Properties of Amorphous Silicon Carbide, Silicon Nitride and Germanium Carbide Prepared by the Glow Discharge Technique, vol. 35, pages 1–36 of Philosophical Magazine, 1978. The essence of this technique is to change the band gap greatly by varying the proportion of the carbide component of a deposited amorphous silicon carbide film or the nitride component of a deposited amorphous silicon nitride film. To state more specifically, in depositing an amorphous silicon carbide or nitride film, a barrier can be formed by varying the band gap by changing the proportion of silane gas to hydrocarbon gas or that of silane gas to ammonia gas so as to control the carbide or nitride content of the amorphous film.

The present invention has the following advantages:

(1) A sharp image can be formed without using a complex process but by making effective use of a photoreceptor having a special layer arrangement;

(2) The photoreceptor can be subjected to cyclic use with minimum buildup of residual charges;

(3) The photoreceptor and the image forming method using it are stable against temperature and humidity changes;

(4) Depending on the specific use, the photoreceptor can use a suitable protective layer that little affects the photosensitivity of the photoconductive layer;

(5) The protective layer has high mechanical strength even if it is relatively thin;

(6) Organic photoreceptors often experience reduced sensitivity and increased residual potential upon illumination with ultraviolet rays, but because of the filter effect of the protective layer, these defects seldom occur in the photoreceptor of the present invention; and (7) The photoreceptor has sufficiently high mechanical strength to withstand the use of a He-Ne laser light or semiconductor laser as a light source for exposure.

The present invention is now described in greater detail by reference to the following examples and comparative examples which are given here for illustrative purposes only and are by no means intended to limit the scope of the present invention.

EXAMPLE 1

A photoconductive layer of Se-As alloy was vacuum deposited on an aluminum drum (OD=120 mm, length=320 mm) in a thickness of 60μ. A protective layer 1μ thick was formed on the photoconductive layer by decomposing argon gas (5 vol% $SiH_4$ and 15 vol% $C_2H_4$) in a high-frequency glow discharge device (13.56 MHz) at 0.5 Torr. The resulting photoreceptor was subjected to a copying test with a modified U-Bix V2 (product of Konishiroku Photo Industry Co., Ltd.) that effected a process comprising the steps of charging, full-frame exposure (with EL panel having a maximum radiation peak at 495 nm), imagewise exposure (with He-Ne laser), development, transfer, fixing, erasure and cleaning. Two hundred thousand copies were obtained and they all had a sharp image.

EXAMPLE 2

A photoreceptor which was the same as prepared in Example 1 was subjected to a copying test with a modified U-Bix V2 that effected a process comprising the steps of charging, imagewise exposure (with He-Ne laser), full-frame exposure (with EL panel having a maximum radiation peak at 495 nm), development, transfer, fixing, erasure and cleaning. Two hundred thousand copies were obtained and they all had a sharp image.

COMPARATIVE EXAMPLE 1

The procedure of Example 1 was repeated except that the protective layer comprised a mixture of equal amounts of polyester, polyvinylidene chloride and acetylcellulose. When about ten thousand copies were made, the protective layer was damaged and fog increased to impair the image quality.

EXAMPLE 3

A conductive support having an aluminum film vapor-deposited on a polyethylene terephthalate substrate 100μ thick was successively coated with an intermediate layer (0.1μ thick) of vinyl chloride-vinyl acetate-maleic anhydride copolymer ("Eslec MF-10" from Sekisui Chemical Co., Ltd.) and a charge generating layer applied in a dry thickness of 0.8μ from a solution of Diane Blue C.I. No. 21180 in n-butylamine. A charge transport layer was then formed by applying to the charge generating layer a solution having 10 g of a polycarbonate resin ("Panlite L-1250" of Teijin Chemicals Ltd.) and 5 g of 1-phenyl-3-(4-diethylaminostyryl)-5(4-diethylaminophenyl) pyrazoline dissolved in 100 ml of 1,2-dichloroethane, and drying the coating at 70° C. for one hour to give a thickness of 13μ. A protective layer 0.5μ thick was formed on the charge transport layer by decomposing argon gas (17 vol% $NH_3$ 3 vol% $SiH_4$) in a high-frequency glow discharge device (13.56 MHz) at 0.3 Torr. The resulting photoreceptor was subjected to a copying test with a modified U-Bix V2 that effected a process comprising the steps of charging, full-frame exposure (with EL panel emitting light having a wavelength range of 400–440 nm), imagewise exposure (with He-Ne laser), development, transfer, fixing, erasure and cleaning. Forty thousand copies were obtained, and they all had a sharp image.

COMPARATIVE EXAMPLE 2

The procedure of Example 3 was repeated except that the photoreceptor had no protective layer. When the thousand copies were made, toner streaking occurred to impair the image quality.

COMPARATIVE EXAMPLE 3

A photoreceptor was prepared as in Example 3 except that a $SiO_2$ protective layer 0.5μ thick was sputtered on the photosensitive layer with an argon-filled high-frequency sputtering device (13.56 MHz) at 0.1 Torr. The resulting photoreceptor and that of Example 3 were subjected to a continuous copying test with a commerical copier (U-Bix 2000 RIII of Konishiroku Photo Industry Co., Ltd.), and the potential in the background of the photosensitive layer was measured at an exposure aperture of 2.5 with an Electrostatic Voltmeter 144 D-1D of Monroe Electronics Incorporated. The results are shown in Table 1.

TABLE 1

| | Background Potential (V) | | |
|---|---|---|---|
| Sample | Initial | After 500 Copies | Increase |
| Ex. 3 | −15 | −20 | 5 |
| Com. Ex. 3 | −20 | −110 | 90 |

EXAMPLE 4

A conductive support having a thin aluminum film laminated on a polyethylene terephthalate substrate 75μ thick was successively coated with an intermediate layer (0.1μ thick) of vinyl chloride-vinyl acetate-maleic anhydride copolymer ("Eslec MF-10" from Sekisui Chemical Co., Ltd.) and a charge generating layer of N,N'-dimethylperylene-3,4,9,10-tetracarboxylic acid diimide (Variogen Maroon 3920, C.I. No. 71130) that was vacuum-deposited in a thickness of 0.3μ. A charge transport layer was then formed by applying to the charge generating layer a solution having 5 g of 2,5-bis(4-diethylaminophenyl)-1,3,4-oxadiazole and 10 g of polycarbonate resin ("Panlite L-1250" of Teijin Chemicals Ltd.) dissolved in 100 ml of 1,2-dichloroethane, and drying the coating at 70° C. for one hour to give a thickness of 13μ. A protective layer 0.4μ thick was formed on the charge transport layer by decomposing argon gas (17 vol% $C_2H_4$ and 3 vol% $SiH_4$) in a high-frequency glow discharge device (13.56 MHz) at 0.5 Torr. The resulting photoreceptor was subjected to a continuous copying test with U-Bix 2000 RIII, and 30,000 copies having a sharp image were produced.

COMPARATIVE EXAMPLE 4

The procedure of Example 4 was repeated except that the photoreceptor had no protective layer. When 15,000 copies were made, toner streaking occurred and a sharp image was not obtained.

EXAMPLE 5

A conductive support having a thin aluminum film laminated on a polyethylene terephthalate substrate 75μ thick was successively coated with an intermediate layer (0.1μ thick) of vinyl chloridevinyl acetate-maleic anhydride copolymer ("Eslec MF-100" of Sekisui Chemical Co., Ltd.) and a charge generating layer 0.5μ thick that was formed by vapor-depositing an anthanthrone pigment ("Monolight Red 2Y", C.I. No. 59300) at 350° C. for 3 minutes under $2\text{–}3\times10^{-4}$ Torr. Then, a charge transport layer was formed by applying to the charge generating layer a solution having 5 g of hydrazone compound of the formula:

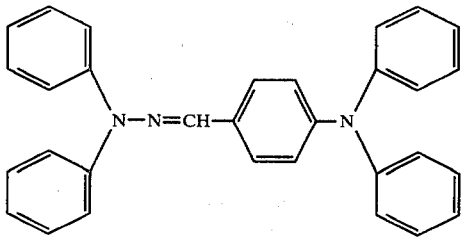

and 10 g of polycarbonate resin ("Panlite L-1250" of Teijin Chemicals Ltd.) dissolved in 100 ml of 1,2-dichloroethane, and drying the coating at 70° C. for one hour to give a thickness of 12μ. A protective layer 0.2μ thick was formed on the charge transport layer by decomposing argon gas (18 vol% $NH_3$ and 2 vol% $SiH_4$) in a high-frequency glow discharge device (13.56 MHz) at 0.2 Torr. The resulting photoreceptor was referred to as Sample No. 1. It was subjected to a copying test with U-Bix 2000 RIII, and 40,000 copies having a sharp image were obtained. Control Sample No. 1 that was the same as Sample No. 1 except that it had no protective layer was subjected to the same test, but when 15,000 copies were made, toner streaking occurred to prevent the formation of a sharp image.

EXAMPLE 6

A photoreceptor (Control Sample No. 2) the same as Sample No. 1 was prepared; the only difference was that a protective layer was prepared by applying a solution of ester acrylate resin ("Alonix M-8060" of Toa Gosei Chemical Co., Ltd.) in toluene to the double-layer photosensitive layer with a doctor blade, and drying the coating at 80° C. for 6 hours to give a thickness of 2μ. Sample No. 1 and Control Sample 2 were subjected to a continuous copying test with U-Bix 2000 RIII and the potential in the background of the photosensitive layer was measured at an exposure aperture of 2 with an Electrostatic Voltmeter 144 D-1D of Monroe Electronics Incorporated. The results are shown in Table 2.

TABLE 2

| Photoreceptor | Background Potential (V) Initial | After 100 Copies | Increase |
|---|---|---|---|
| Sample No. 1 | −80 | −90 | 10 |
| Control Sample No. 2 | −85 | −190 | 105 |

As a result of cyclic use, the background potential of Control Sample No. 2 was increased significantly, and the resulting copies were so foul in the background area that they were hardly suitable for practical use.

EXAMPLE 7

A conductive support having a thin aluminum fulm laminated on a polyethylene terephthalate substrate 90μ thick was successively coated with an intermediate layer (0.1μ thick) of vinyl chloride-vinyl acetate-maleic anhydride copolymer ("Eslec MF-100" of Sekisui Chemical Co., Ltd.) and a charge generating layer 0.5μ thick that was formed by vapor-depositing an anthanthrone pigment ("Monolight Red 2Y", C.I. No. 59300) at 350° C. for 3 minutes under $2\text{–}3\times10^{-4}$ Torr. Then, a charge transport layer was formed by applying to the charge generating layer a solution having 5 g of a hydrazone compound of the formula:

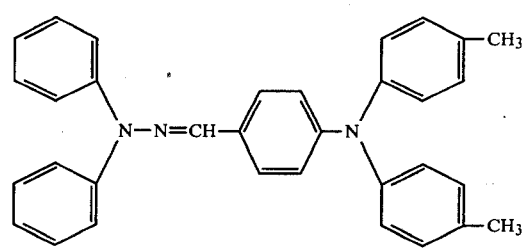

and 10 g of polycarbonate resin ("Panlite L-1250" of Teijin Chemicals Ltd.) dissolved in 100 ml of 1,2-dichloroethane, and drying the coating at 70° C. for one hour to give a thickness of 13μ. A protective layer 0.4μ thick was formed on the charge transport layer by decomposing argon gas (3 vol% $SiH_4$ and 17 vol% $C_2H_4$) in a high-frequency glow discharge device (13.56 MHz) at 0.5 Torr. The resulting photoreceptor was referred to as Sample No. 2. Control Sample No. 3 was prepared in the same manner except that it had no protective layer. The two samples were set in an Electrometer SD-428 of Kawaguchi Electric Works Co., Ltd. and charged to a negative 6 kilovolts for 5 seconds. The charge potential Vo (V) on the surface of the photosensitive layer just after the charging step and the light flux necessary to reduce it by half $E_{\frac{1}{2}}$ (1x.sec.) were measured. The same measurement was made after 5-second exposure to an ultra-high pressure mercury lamp SHL-100 UV of Tokyo Shibaura Electric Co., Ltd. placed at a distance of 5 cm. The results are shown in Table 3.

TABLE 3

| Photoreceptor | Vo (V) | $E_{\frac{1}{2}}$ (1x.sec.) |
|---|---|---|
| Sample No. 2 | −750 | 3.2 |

TABLE 3-continued

| Photoreceptor | Vo (V) | E ½ (lx.sec.) |
|---|---|---|
| Sample No. 2 (After UV Irradiation) | −760 | 3.3 |
| Control Sample No. 3 | −700 | 2.9 |
| Control Sample No. 3 (After UV Irradiation) | −800 | 4.2 |

The sensitivity of Control Sample No. 3 was decreased greatly upon exposure to ultraviolet radiation whereas Sample No. 2 remained stable against UV radiation.

What is claimed is:

1. A method of forming a latent electrostatic image including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of imagewise exposure to light that is absorbed by said photosensitive layer but not substantially absorbed by said protective layer, and a step of full-frame exposure to light that is absorbed by said protective layer but not substantially absorbed by said photosensitive layer.

2. A method according to claim 1 wherein the full-frame exposure is effected before the imagewise exposure and simultaneously with or after or immediately before the formation of a uniform charge layer.

3. A method according to claim 1 wherein the imagewise exposure is effected before the full-frame exposure and simultaneously with or after or immediately before the formation of a uniform charge layer.

4. A method according to claim 1 wherein the imagewise exposure is effected simultaneously with or after or immediately before the formation of a uniform charge layer and no step of full-frame exposure is included.

5. A method according to claim 1 wherein the photoconductive protective layer comprises a photoconductive inorganic compound.

6. An electrophotographic process including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of imagewise exposure to light that is absorbed by said photosensitive layer but not substantially absorbed by said protective layer, said imagewise exposure being effected simultaneously with or after or immediately before the formation of a uniform charge layer, a step of full-frame exposure to form a latent electrostatic image with light that is absorbed by said protective layer but not substantially absorbed by said photosensitive layer, a step of forming a visible image by developing the latent image with a developer containing charged particles, a step of transferring the visible image onto a receiving sheet to form a transfer image and fixing it, and a step of erasing any residual charges by illuminating the entire surface of the photosensitive layer with cleaning light and/or by applying an a.c. voltage thereto.

7. An electrophotographic process according to claim 6 wherein the cleaning light has the wavelength range of absorption for the photosensitive layer.

8. An electrophotographic process according to claim 6 wherein the cleaning light has the wavelength range of absorption for both the photosensitive layer and the protective layer.

9. An electrophotographic process according to claim 6 wherein the photoconductive protective layer comprises a photoconductive inorganic compound.

10. An electrophotographic process including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of imagewise exposure to form a latent electrostatic image with light that is absorbed by said photosensitive layer but not substantially absorbed by said protective layer, said imagewise exposure being effected simultaneously with or after or immediately before the formation of a uniform charge layer, a step of full-frame exposure to form a latent electrostatic image with light that is absorbed by said protective layer but not substantially absorbed by said photosensitive layer, a step of forming a visible image by developing the latent image with a developer containing charged particles, a step of transferring the visible image onto a receiving sheet to form a transfer image and fixing it, and a step of erasing any residual charges by illuminating the entire surface of the photosensitive layer with a cleaning light and/or by applying an a.c. voltage thereto.

11. An electrophotographic process according to claim 10 wherein the cleaning light has the wavelength range of absorption for the photosensitive layer.

12. An electrophotographic process according to claim 10 wherein the cleaning light has the wavelength range of absorption for both the photosensitive layer and the protective layer.

13. An electrophotographic process according to claim 10 wherein the photoconductive protective layer comprises a photoconductive inorganic compound.

14. An electrophotographic process including a step of forming a uniform charge layer on the surface of a photoreceptor comprising a conductive support having successively formed thereon a photoconductive photosensitive layer and a photoconductive protective layer, said photosensitive layer being capable of absorbing at least light in a wavelength range other than that for said protective layer, a step of imagewise exposure to form a latent electrostatic image with light that is absorbed by said photosensitive layer but not substantially absorbed by said protective layer, said imagewise exposure being effected simultaneously with or after or immediately before the formation of a uniform charge layer, a step of forming a visible image by developing the latent image with a developer containing charged particles, a step of transferring the visible image onto a receiving sheet to from a transfer image and fixing it, and a step of erasing any residual charges by illuminating the entire surface of the photosensitive layer with a cleaning light and/or by applying an a.c. voltage thereto.

15. An electrophotographic process according to claim 14 wherein the cleaning light has the wavelength range of absorption for the photosensitive layer.

16. An electrophotographic process according to claim 14 wherein the cleaning light has the wavelength range of absorption for both the photosensitive layer and the protective layer.

17. An electrophotographic process according to claim 14 wherein the photoconductive protective layer comprises a photoconductive inorganic compound.

18. A photoreceptor for electrophotography that comprises an electrically conductive support having successively formed thereon a photoconductive photosensitive layer and a protective layer for that photosensitive layer, said photosensitive layer being capable of absorbing at least light in a wavelength range other than that for said protective layer.

19. A photoreceptor according to claim 18 wherein said photosensitive layer consists of a charge generating layer and a charge transport layer.

20. A photoreceptor according to claim 18 wherein said protective layer is from 0.01 to 5$\mu$ thick.

21. A photoreceptor according to claim 18 wherein said photosensitive layer comprises an photoconductive organic material.

22. A photoreceptor according to claim 18 wherein said protective layer comprises an amorphous silicon carbide or amorphous silicon nitride containing a hydrogen atom and/or a fluorine atom.

* * * * *